US008425156B2

(12) United States Patent
Thomas

(10) Patent No.: US 8,425,156 B2
(45) Date of Patent: Apr. 23, 2013

(54) UNDERWATER BUOY WITH MODULAR MEMBERS

(75) Inventor: Pierre-Armand Thomas, Puteaux (FR)

(73) Assignee: Technip France (FR)

( * ) Notice: Subject to any disclaimer, the term of this patent is extended or adjusted under 35 U.S.C. 154(b) by 124 days.

(21) Appl. No.: 12/597,627

(22) PCT Filed: Apr. 24, 2008

(86) PCT No.: PCT/FR2008/000590

§ 371 (c)(1),
(2), (4) Date: Dec. 10, 2009

(87) PCT Pub. No.: WO2008/145862

PCT Pub. Date: Dec. 4, 2008

(65) Prior Publication Data

US 2010/0111614 A1 May 6, 2010

(30) Foreign Application Priority Data

Apr. 27, 2007 (FR) ..... 07 03086

(51) Int. Cl.
*B63B 22/18* (2006.01)

(52) U.S. Cl.
USPC ..... 405/224.2; 405/224; 166/350; 166/367

(58) Field of Classification Search ..... 405/171, 405/173, 224, 224.2, 227; 166/350, 367
See application file for complete search history.

(56) References Cited

U.S. PATENT DOCUMENTS

| | | | | |
|---|---|---|---|---|
| 6,439,810 | B1 | 8/2002 | Nish et al. | |
| 6,848,863 | B2 * | 2/2005 | Karayaka et al. | 405/211 |
| 6,896,062 | B2 * | 5/2005 | Davies et al. | 166/350 |
| 7,008,141 | B2 * | 3/2006 | Fitzgerald et al. | 405/224.2 |
| 2004/0062612 | A1 * | 4/2004 | van Belkom et al. | 405/211 |
| 2004/0253059 | A1 * | 12/2004 | Horton, III | 405/195.1 |
| 2005/0019102 | A1 * | 1/2005 | Copple et al. | 405/195.1 |
| 2005/0117974 | A1 | 6/2005 | Karayaka et al. | |

FOREIGN PATENT DOCUMENTS

| | | |
|---|---|---|
| WO | WO 02/40821 A | 5/2002 |
| WO | WO 03/064807 A | 8/2003 |

OTHER PUBLICATIONS

International Search Report dated May 11, 2009, issued in corresponding international application No. PCT/FR2008/000590.

* cited by examiner

*Primary Examiner* — David Bagnell
*Assistant Examiner* — Benjamin Fiorello
(74) *Attorney, Agent, or Firm* — Ostrolenk Faber LLP

(57) ABSTRACT

An underwater buoy for hanging a duct between a sea bed and the surface, the buoy including a frame and a plurality of modular members mounted in the frame, the modular members extending between their two opposite modular-member ends, the frame including a longitudinal body for receiving the extended tubular duct, and retainers mounted on the body for maintaining the modular members substantially parallel to the body. The retainers include two retaining structures spaced from each other along the body. The retaining structures are maintained in a fixed position relative to each other in order to hold at least one modular member.

11 Claims, 4 Drawing Sheets

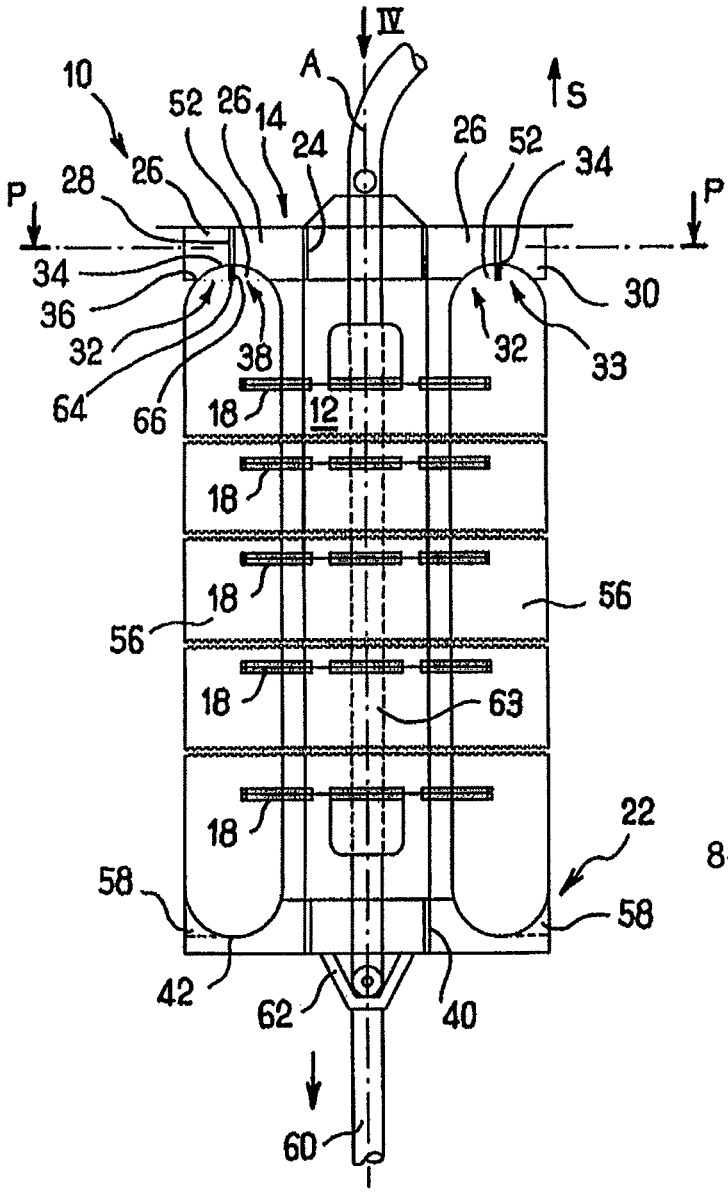
Fig.3A
Fig.3B
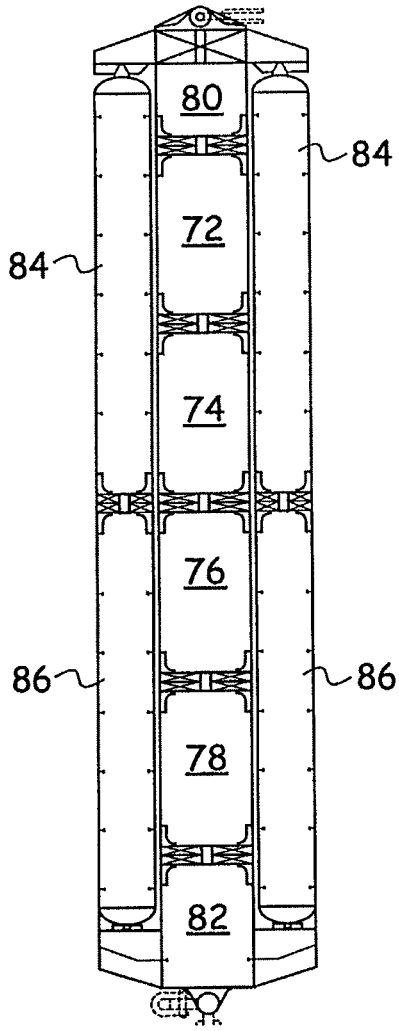

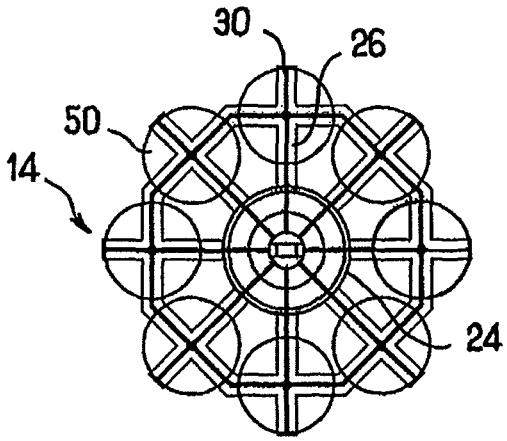
Fig.4
Fig.5A
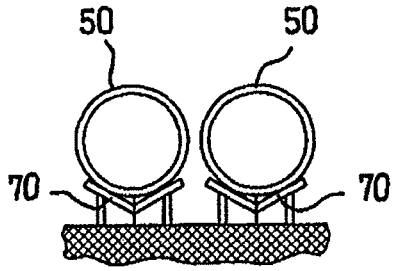
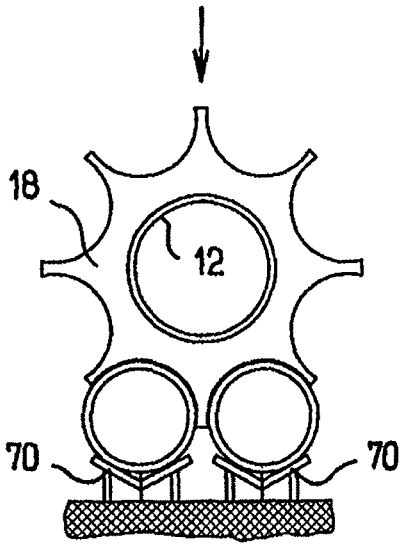
Fig.5B
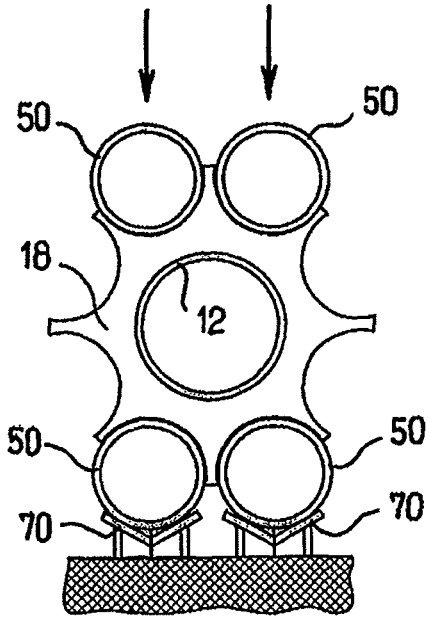
Fig.5C

UNDERWATER BUOY WITH MODULAR MEMBERS

CROSS REFERENCE TO RELATED APPLICATION

The present application is a 35 U.S.C. §§371 national phase conversion of PCT/FR2008/000590, filed Apr. 24, 2008, which claims priority of French Application No. 0703086, filed Apr. 24, 2007, incorporated by reference herein. The PCT International Application was published in the French language.

BACKGROUND OF THE INVENTION

The present invention relates to an underwater buoy with modular members for suspending tubular ducts for transporting hydrocarbons between a seabed and a surface installation.

In order to raise hydrocarbons from an underwater well to the surface, tubular ducts are installed substantially vertically between the well and an underwater area situated below the surface of the water, after which these vertical tubular ducts are extended by generally flexible tubular ducts which join a surface installation. The substantially vertical tubular ducts are generally rigid and are held vertical by underwater buoys. The size of these underwater buoys and consequently the volume of air that they are able to trap can be adjusted as a function of the upward force that they must exert on the tubular duct in order to hold it vertical. This upward force also depends on the dimensions of the duct and its length, in other words the depth of water. Moreover, if the upward force to be exerted is relatively high, the volume of the underwater buoy must also be high. Furthermore, because it is difficult to transport buoys of large volume, transporting them in pieces has been envisaged, for example on laying ships, and then assembling them directly on site.

Thus the buoys comprise a frame and modular members that form floats adapted to be mounted on said frame when the buoy is installed. The modular members extend longitudinally between two opposite modular member ends. Said frame has a longitudinal hollow body adapted to receive said extended tubular duct and radial retaining means mounted on said hollow body hold said modular members substantially parallel to said hollow body and around said hollow body.

Reference may be made in particular to the document WO 03/064807, which describes one such underwater buoy.

However, when the modular members are relatively bulky so that the underwater buoy exerts a relatively high upward force, the retaining means are intensely loaded and there is a risk of them breaking.

SUMMARY OF THE INVENTION

Thus a problem that arises and that the present invention aims to solve is to provide an underwater buoy with modular members that are retained more strongly by the retaining means to prevent them breaking.

With the aim of solving this problem, the present invention proposes an underwater buoy with modular members intended to suspend a tubular duct between a seabed and a surface. The buoy comprises a frame and a plurality of modular members forming floats adapted to be mounted in the frame. The modular members extend longitudinally between two opposite modular member ends. The frame has a longitudinal hollow body intended to receive the extended tubular duct and retaining means mounted radially on the hollow body to hold the modular member substantially parallel to the hollow body and around the hollow body. According to the invention, the retaining means comprise two facing retaining structures spaced longitudinally from each other on the hollow body. The retaining structures have respective pluralities of receiving areas each adapted to receive a modular member end. The said retaining structures are held in a fixed position relative to each other in a position in which the receiving areas face each other so as to trap at least one modular member when the opposite ends of the at least one modular member are engaged in respective facing receiving areas.

Accordingly, one feature of the invention is the way the two retaining structures cooperate, trapping the modular members when they are brought into a position close to each other. As a result, when the tubular duct that rises from the seabed is suspended from the underwater buoy, the buoy is oriented so that the hollow body extends substantially vertically, just like the modular members. The modular members, which have a density lower than that of seawater, exert an upward force on one of the two retaining structures that is itself fastened to the hollow body. Also, these modular members abut against this retaining structure and are held in this position thanks in particular to the other retaining structure.

Each modular member is advantageously of cylindrical shape with a circular directrix so that they can be fabricated industrially and at an advantageous cost. Given the symmetry of these modular members, their wall offers a much higher resistance to hydrostatic pressure despite a relatively small thickness compared to a modular member of parallelepiped shape, for example. What is more, thanks to this cylindrical symmetry, the modular members are more easily manipulated in the water in order to replace a modular member or to mount additional modular members in the frame.

Moreover, the retaining means preferably further include spacers mounted on the hollow body to hold the modular members away from the hollow body, and the modular members bearing against these spacers. They also stiffen the connections between the modular members and the hollow body. Moreover, the spacers have respective semicircular recesses to receive the modular member and thus prevent lateral movement of the tubular member in directions substantially parallel to a plane tangential to the hollow body.

In a preferred embodiment of the invention, the retaining structures have a central portion fastened to the hollow body and radial portions in which the receiving areas are provided. For example, the retaining structures thus have eight radial portions diametrally opposed in pairs in which respective receiving areas are provided.

Moreover, the retaining structures define a mean plane that is substantially perpendicular to the hollow body. At least one of the retaining structures, that which is at the surface end when the underwater buoy is in position, is equipped with complementary immobilizing means in the receiving areas to immobilize the modular member in all directions substantially parallel to the mean plane. Thus, when the underwater buoy is in the normal working position, the hollow body is oriented vertically and the modular members, having density lower than that of water, tend to rise toward the surface and to exert upward forces precisely on the at least one of the retaining structures. Also, thanks to the additional immobilizing means, in the receiving areas of this retaining structure, which means absorbs the high upward forces, the ends of the modular members are totally fastened to the retaining structure. Because of this, the modular members are totally fastened to the frame.

The at least one of said retaining structures, at the surface end, advantageously reinforcing means for increasing the stiffness of the at least one of the retaining structures to better resist the upward forces produced by the modular members.

At the opposite end, the hollow body has in the vicinity of the other of the retaining structures means for attachment to the tubular duct to absorb the forces exerted by the tubular duct that rises from the seabed and tends to drag the underwater buoy toward the seabed. Thus these forces are exerted directly on the hollow body and are absorbed and compensated by the modular members via the retaining structure. Of course, the other retaining structure, facing the seabed, includes means for locking the modular members in order for them to be totally fastened to the hollow body.

Other features and advantages of the invention will emerge from a reading of the description of particular embodiments of the invention given hereinafter by way of nonlimiting illustration and with reference to the appended drawings, in which:

BRIEF DESCRIPTION OF THE DRAWINGS

FIG. 3A is a diagrammatic view of the underwater buoy shown in FIG. 2 in axial section on the plane III-III;

FIG. 3B is a diagrammatic view of different embodiment of an underwater buoy of the invention in axial section in a vertical plane;

FIG. 4 is a diagrammatic plan view of the underwater buoy represented in FIG. 3A in the direction of the arrow IV; and FIGS. 5A to 5C show diagrammatically in cross section the assembly of an underwater buoy as shown in FIG. 2.

DESCRIPTION OF THE PREFERRED EMBODIMENT

Figure 1:
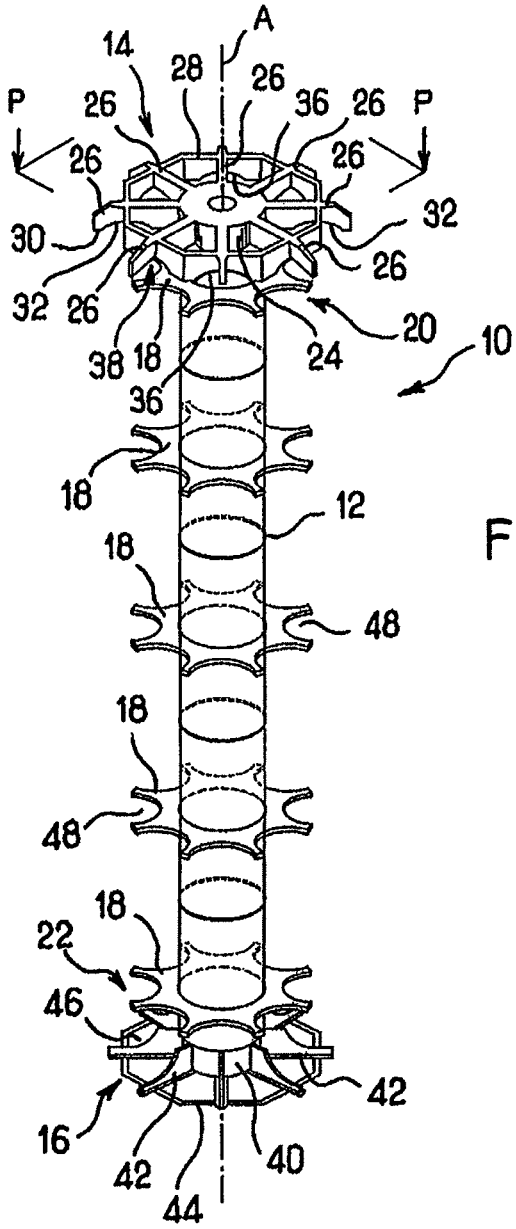
FIG. 1 is a diagrammatic perspective view of a frame of an underwater buoy of the invention.

FIG. 1 shows the frame 10 of an underwater buoy of the invention. This frame 10 has a hollow body 12 between 30 and 40 meters long, for example 35 meters long, and an upper retaining structure 14 and a lower retaining structure 16. Moreover, spacers 18 to be described hereinafter are installed along the hollow body 12. This hollow body 12, which is of circular symmetry about an axis A, has an upper end 20 and a lower end 22 and its relatively constant diameter is between 1 meter and 2 meters, for example 1.5 meters. The upper retaining structure 14 has a central portion consisting of a first interior ring 24 at least partially sleeved into the upper end 20 of the hollow body 12 and eight radial portions consisting of first branches 26 that extend radially from the first interior ring 24 and are offset from each other at an angle close to 45°, these first branches 26 being also fastened to a first exterior ring 28 of octahedron shape. This first exterior ring 28 constitutes in particular means for stiffening the upper retaining structure 14.

The first branches 26 each have a free end 30 and an arcuate first recess 32 near the free end 30. This arcuate first recess 32 is oriented toward the lower end 22. FIG. 3A shows the frame 10 comprising the hollow body 12 and the upper retaining structure 14; the axial section plane III-III intersecting two diametrally opposite first branches 26, their respective arcuate recesses 32 are seen to be symmetrical with respect to an extremum (maximum point) 34 and symmetrical to each other with respect the axis of symmetry A. Moreover, the arcuate first recesses 32 are spaced from the hollow body 12.

Seen in FIG. 1 is the first exterior ring 28, which is of octahedron shape and connects the first branches 26 together at the level of the arcuate first recesses 32. Each of the eight substantially plane portions of the first exterior ring 28 intersects substantially perpendicularly a first branch 26. Moreover, an arcuate second recess 36 is produced in each of these plane portions of the first exterior ring 28. This arcuate second recess 36 is of substantially identical curvature to the first recess 32 and has an extremum substantially coinciding with the extremum 34 of the arcuate first recess 32.

Thus, thanks to the arcuate recesses 32, 36, the plane portions of the first exterior ring 28 and the corresponding first branch 26 together define a receiving area 38 which is oriented toward the lower end 22 and defines a spherical ring the function of which is explained hereinafter.

First, the lower retaining structure 16 is described with reference to FIG. 1 and to FIG. 3A. The latter structure has a second interior ring 40 at least partly sleeved into the lower end 22 of the hollow body 12. It also has second branches 42 symmetrical to respective first branches 26 with respect to a plane of symmetry intersecting the hollow body 12 perpendicularly half way between the lower end 22 and the upper end 20. These second branches 42 are connected to each other by an exterior second ring 44. On the other hand, the second branches 42 have respective notches 46 rather than an arcuate recess like the opposite first branches 26. On the other hand, the notch 46 has a first portion located close to the second interior ring 40 substantially symmetrical to a first part 32 of an arcuate recess extending from the extremum 34 toward the first interior ring relative to the aforementioned plane of symmetry intersecting the hollow body 12 perpendicularly. However, a second portion of the notch 46 extends substantially radially toward the free end of the second branch 42.

Moreover, the star-shaped spacers 18 shown in detail in FIG. 1 each define a mean plane substantially perpendicular to the hollow body 12 and are formed from a circular ring in which eight semicircular recesses 48 are produced. The semicircular recesses 48 of each of the circular rings are aligned with each other along an axis parallel to the axis of symmetry A of the hollow body 12 and each intersects facing first and second branches 26, 42.

Figure 2:
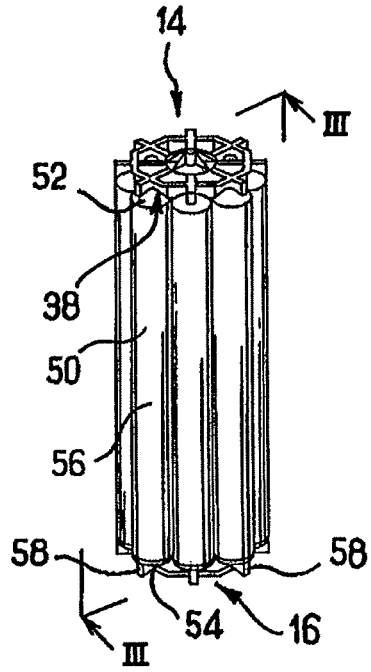
FIG. 2 is a diagrammatic perspective view of an underwater buoy of the invention.
Figure 6:
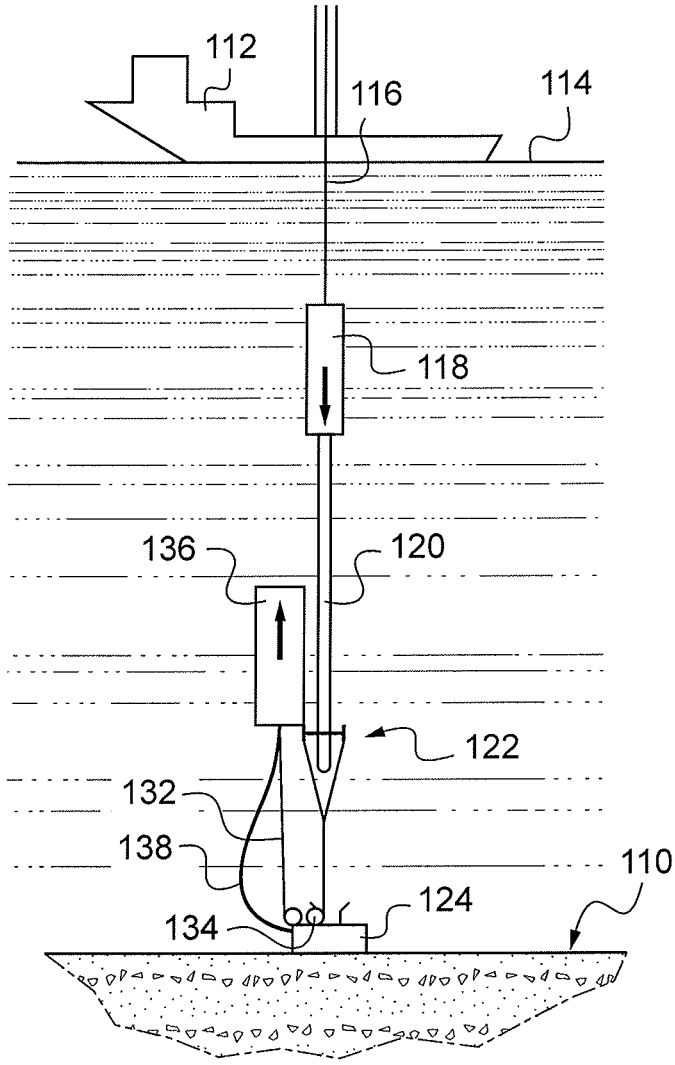
FIG. 6 illustrates a seabed installation anchored to the seabed, the suspension of a line from a surface vessel, the direction changing device on the seabed installation, the controlling of a traction cable at the connecting end of the duct, the submerged pulling buoy attached to the traction cable and other aspects of the disclosure.

As shown in FIG. 2, modular members 50 forming floats are engaged in each of the eight housings that extend between the upper retaining structure 14 and the lower retaining structure 16 and are defined by the semicircular recesses 48 of the spacers 18, the receiving areas 38 and the opposite notches 46. FIG. 2 shows the upper retaining structure 14 and the lower retaining structure 16 connected together by the hollow body 12, here concealed by the modular members 50. The latter are of cylindrical shape with a circular directrix and each has two opposite free ends, an upper free end 52 and a lower free end 54. Their diameter is between 2 and 3 meters, for example 2.4 meters, and their length is between 30 meters and 40 meters, for example 34 meters.

The two free ends have a rounded shape defining a substantially spherical surface adapted to coincide with the receiving area 38. Thus the upper free end 52 of each of the two modular members 50 is engaged in the receiving area 38, the lower free end 54 bears against the corresponding second branch 42, and the body 56 of each of the tubular members 50 bears against the spacers 18, passing through their respective semicircular recesses 48. Note that when assembling the underwater buoy the upper free end 52 of the modular members 50 is first engaged in the receiving area 38, the modular members 50 being inclined relative to the hollow body 12, and the tubular body 50 is then tilted toward the hollow body 12 into bearing engagement with the spacers 18, with the lower free end 54 abutted against the second branches 42. The modular members 50 are retained in this position either by locking members 58 attached to the free end of the second branches 42, seen in more detail in FIG. 3A, or by a buoy clamp, not shown, that surrounds and grips the eight modular members 50 in the vicinity of the lower retaining structure 16.

Furthermore, in another embodiment, the modular members 50 are held in bearing engagement against the spacers 18, independently of each other, by independent spacer clamps, which clamp the modular members 50 into their corresponding semicircular recesses 48. The spacer clamps are mounted on each of the projecting ends of the spacers 18 and are adapted to be connected to another contiguous projecting end surrounding a modular member 50.

Moreover, in one particular embodiment of the invention shown in FIG. 3A, the upper free end 52 has an axial slot 64 in which engages a projecting extension 66 of the plane portions of the first exterior ring 28 at the level of the arcuate second recess 36. As a result, the upper free end 52 of the modular members 50 is perfectly fastened to the upper retaining structure 14 because it is perfectly immobilized against movement in directions substantially parallel to the mean plane P defined by the upper retaining structure 14. Furthermore, the lower free end 54 is immobilized against movement in radial translation by the locking member 58 and the body 56 of the modular member 50 is immobilized against movement in translation in a perpendicular direction.

FIG. 4 is a plan view of the underwater buoy of the invention. It shows each of the eight modular members engaged in its housing and the upper retaining structure 14 comprising the first interior ring 24, the first branches 26 and the first exterior ring 28.

Thus the underwater buoy represented is relatively easy to assemble before being loaded onto a laying ship or on the ship or directly in the water. Moreover, it has eight modular members 50 here, but it could have only one in two of them, i.e. four modular members 50. This would reduce its buoyancy.

FIGS. 5A to 5C show the assembly of the underwater buoy. First, two first modular members 50 are placed horizontally and parallel to each other on supports 70 and spaced by a particular distance. Then, as shown in FIG. 5B, a hollow body 12 equipped with its spacers 18 is fitted to these first two modular members 50. The latter are then fastened to the spacers 18 by spacer clamps as mentioned above. Then, as shown in FIG. 5C, two more modular members 50 are mounted on the hollow body in the position diametrally opposite the first two modular members 50. Finally, the assembly, equipped with four modular members 50, is first tilted onto two first modular members 50 on supports identical to the supports shown in FIG. 5A and situated alongside those supports 70, and then two other modular members 50 are installed on the last two remaining places on the hollow body 12.

The upper retaining structure 14 and the lower retaining structure 16 are then mounted on the ends of the hollow body 12.

As shown in FIG. 3A, the underwater buoy of the invention is attached by means of a clamp 62 to a tubular duct 60 for transporting hydrocarbons. As a result, the tubular duct 60 is suspended from the underwater buoy, which tends to draw it in the direction S of the surface in an underwater area situated below the surface. Furthermore, the tubular duct 60 is connected to a flexible tubular duct 63 that passes through the underwater buoy and exits it at the top beyond the upper retaining structure 14 to join a surface installation.

Thus the traction forces to be exerted on the tubular duct 60 can be adapted by adjusting the number of modular members 50 attached to the frame 10.

In another embodiment, not shown, the tubular duct 60 is connected to the underwater buoy by a frame itself suspended from the lower retaining structure 16 and the tubular duct 60 is connected to a flexible tubular duct, which no longer passes through the underwater buoy but instead passes around it to join a surface installation.

In a variant of the invention represented in FIG. 3B and in said other embodiment the aforementioned hollow body is replaced by a succession of six independent floats, comprising four identical floats 72, 74, 76, 78 and two end floats 80, 82 stacked one on the other. Furthermore, the modular members forming floats are respectively replaced here by two modular half-members 84, 86 arranged in alignment with each other. The result of substituting the independent cylindrical float 72, 74, 76, 78, 80, 82 for the hollow body is to increase the overall buoyancy of the underwater buoy. Moreover in some particular embodiments, for the same buoyancy, the modular members are smaller. Moreover, increasing the number of floats that are decoupled from each other avoids the risk if one of them is damaged. The independent cylindrical floats 72, 74, 76, 78, 80, 82 are nevertheless adapted to receive water inside them so as to be able to submerge the underwater buoy, whereas the modular half-members are sealed and do not receive water. This water can then be evacuated from the independent cylindrical floats to confer on the underwater buoy its full buoyancy. For filling the independent cylindrical floats 72, 74, 76, 78, 80, 82 with water, they are equipped in their base with a first opening extended by a first pipe. The first pipes of all the independent cylindrical floats 72, 74, 76, 78, 80, 82 converge toward a common filler valve. To substitute a gas and in particular nitrogen for the water in the independent cylindrical floats 72, 74, 76, 78, 80, 82, they have a top opening extended by a second pipe. The second pipes converge toward a common nitrogen feed valve.

Another aspect of the invention relates to a method of installing an underwater riser column for transporting hydrocarbons between a seabed 110 and a surface 114 by means of an underwater buoy 118 with modular members as described above. The method is of the type wherein: a seabed installation 124 is anchored to said seabed 110; a tubular duct 120 is provided having a connecting end 122 intended to be connected to said seabed installation 124 and an opposite end equipped with an underwater buoy 118 with submersible floats; then water is allowed to enter said submersible floats to submerge said underwater buoy 118 and said tubular duct 120 vertically above said seabed installation 124, while said underwater buoy 118 and said duct 120 are retained by a suspension line 116 from a surface vessel 112, said suspension line 116 supporting traction forces corresponding to the weight of said underwater buoy 118 and said duct 120; a traction cable 132 is then provided and direction-changing means 134 are installed on said seabed installation 124 so as to be able to connect said traction cable 132 to said connecting end 122 and to draw said cable 132 through said direction-changing means 134 and simultaneously to draw said connecting end 122 toward said seabed installation 124; according to the invention, a submerged pulling buoy 136 is attached to the traction cable 132 to exert additional traction forces on said suspension line 116; a gas is then substituted for the water in said submersible floats to compensate on the one hand traction forces corresponding to the weight of said underwater buoy 118 and said duct 120 and on the other hand at least some of the additional traction forces; and, finally, said pulling buoy 136 is moored to said seabed installation 124 and said suspension line 116 is progressively released so that said seabed installation 124 absorbs said additional traction forces exerted by the pulling buoy 136, while said underwater buoy 118 exerts said other part of the additional traction forces on said duct 120 to hold it vertical.

Accordingly, additional traction forces can be exerted on said suspension line by the use in accordance with this other aspect of the invention of the pulling buoy when submerged below the surface, i.e. between the seabed and the surface, to be more precise near the seabed, which pulling buoy is attached to the traction cable and then released from it. When released, the pulling buoy, which contains a gas lighter than water, exerts traction on the traction cable in a direction that is reversed by the direction-changing means at the connecting end of the duct and therefore on the suspension line that joins the surface vessel. Thus an additional traction force is exerted on the suspension line in addition to the weight of the duct and the underwater buoy.

Then, by mooring said pulling buoy to said seabed installation and then releasing or progressively paying out said suspension line from the surface vessel, said underwater buoy and said tubular duct descend progressively toward the seabed installation, because the traction cable is drawn through the direction-changing means by the pulling buoy which is itself drawn toward the surface. However, the buoy is retained by the mooring line that connects it to the seabed installation. From this time onward, the forces exerted on the suspension line between the underwater buoy and the surface vessel cancel out. The benefit of this is precisely that, as soon as the forces exerted on the suspension line tend toward zero and, for example, the surface vessel is lifted by the swell in a vertical direction away from the seabed, the forces exerted on the assembly comprising the chain, the suspension lines, the underwater buoy, the duct and the traction cable are then transferred to the pulling buoy, which is therefore drawn toward the seabed. This obviously retains all the elements of the aforementioned chain assembly, as the pulling cable is not anchored to the seabed, as is the case in the prior art.

Said gas lighter than water is advantageously substituted for the water in said submersible floats to compensate the traction forces corresponding to the weight of the underwater buoy and to substantially half said additional traction forces exerted by means of the pulling buoy.

Moreover, in one particular embodiment of the invention, to connect the connection end to said seabed installation, said pulling buoy is released from said seabed installation so that it rises toward said surface so as to draw said connecting end in the opposite direction, toward said seabed installation. To do this, damper means are provided for receiving the connecting end when, on descending, it approaches the seabed installation.

The invention claimed is:

1. An underwater buoy having modular members and configured to suspend a tubular duct between a seabed and a surface, said buoy comprising:

a frame having a longitudinal hollow body configured to receive said extended tubular duct, a plurality of said modular members, each modular member of the plurality of modular members forming a float configured to be replaceably mounted in and to be removable from said frame, each said modular member extending longitudinally between a first modular member end and a second modular member end opposite the first modular member end;

retaining devices mounted radially on said hollow body and configured to hold each said modular member substantially parallel to said hollow body, and said modular members being arrayed around said hollow body;

said retaining devices comprise two opposing retaining structures spaced longitudinally from each other on said hollow body, each retaining structure of said two opposing retaining structures comprising a plurality of receiving areas, each receiving area comprising a branch having a longitudinal extent oriented in a radial direction and positioned directly over or directly under the first modular member end or the second modular member end so as to receive and to trap the first or the second modular member end;

said retaining structures being held in fixed positions relative to each other, such that said receiving areas of said retaining structures face each other and are spaced apart to trap at least one said modular member when said opposite ends of said at least one modular member are engaged in respective facing said receiving areas.

2. The underwater buoy according to claim 1, wherein said retaining devices further include spacers mounted at said hollow body and positioned and configured to hold said modular members at but radially away from said hollow body.

3. The underwater buoy according to claim 2, wherein said spacers have respective recesses to receive said modular member.

4. The underwater buoy according to claim 1, wherein said retaining structures each have a central portion fastened to said hollow body and have radial portions out from said central portion including said receiving areas.

5. The underwater buoy according to claim 4, wherein each said retaining structure has eight said radial portions diametrally opposed in pairs and including eight respective said receiving areas.

6. The underwater buoy according to claim 1, wherein said retaining structures define a mean plane P that is substantially perpendicular to said hollow body, at least one of said retaining structures has a complementary immobilizing device in said receiving areas to immobilize said modular member in all directions substantially parallel to said mean plane.

7. The underwater buoy according to claim 6, wherein said at least one of said retaining structures has a reinforcement configured for increasing the stiffness of said at least one of said retaining structures.

8. The underwater buoy according to claim 7, wherein said hollow body comprises, adjacent another of said retaining structures, an attachment device configured for attachment to said tubular duct.

9. The underwater buoy according to claim 8, wherein said other retaining structure includes a device configured for locking said modular members.

10. The underwater buoy according to claim 1, wherein each said modular member is of cylindrical shape with a circular directrix.

11. A method of installing an underwater riser column for transporting hydrocarbons between a seabed and a surface by means of the underwater buoy with modular members thereon according to claim 1, said method comprising:

anchoring a seabed installation to said seabed;

connecting a tubular duct connecting end to said seabed installation and connecting an opposite tubular duct end with an underwater buoy with submersible floats;

allowing water to enter said submersible floats for submerging said underwater buoy and said tubular duct vertically above said seabed installation, while retaining said underwater buoy and said duct by a suspension line from a surface vessel, and said suspension line supporting traction forces corresponding to the weight of said underwater buoy and said duct;

installing a direction-changing device on said seabed installation and connecting a traction cable to said connecting end of said duct, drawing said cable through said direction-changing device and simultaneously drawing said connecting end toward said seabed installation, attaching a submerged pulling buoy to said traction cable to exert additional traction forces on said suspension line;

then substituting a gas for the water in said submersible floats to compensate on the one hand traction forces corresponding to the weight of said underwater buoy and said duct and on the other hand at least some of the additional traction forces; and mooring said pulling buoy to said seabed installation and progressively releasing said suspension line so that said seabed installation absorbs said additional traction forces exerted by said pulling buoy, while said underwater buoy exerts said other part of the additional traction forces on said duct to hold said duct vertical.

* * * * *

UNITED STATES PATENT AND TRADEMARK OFFICE

CERTIFICATE OF CORRECTION

PATENT NO. : 8,425,156 B2
APPLICATION NO. : 12/597627
DATED : April 23, 2013
INVENTOR(S) : Pierre-Armand Thomas It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 169 days.

Signed and Sealed this
Eighth Day of September, 2015

Michelle K. Lee

Michelle K. Lee
*Director of the United States Patent and Trademark Office*